US005866994A

United States Patent [19]

Nakano

[11] Patent Number: 5,866,994

[45] Date of Patent: Feb. 2, 1999

[54] ILLUMINATION APPARATUS AND FRAME TO WHICH THE ILLUMINATION APPARATUS IS ATTACHED

[75] Inventor: Kazuo Nakano, Nagoya, Japan

[73] Assignee: Timely Elegance Co., Ltd., Nagoya, Japan

[21] Appl. No.: 978,135

[22] Filed: Nov. 25, 1997

[30] Foreign Application Priority Data

Nov. 28, 1996 [JP] Japan ..... 8-334606

[51] Int. Cl.[6] ..... H01J 61/96

[52] U.S. Cl. ..... 315/362; 315/291; 315/360; 315/324; 315/316; 315/314; 315/186; 362/1; 362/2

[58] Field of Search ..... 315/360, 316, 315/314, 291, 324, 292, 362; 362/1

[56] References Cited

U.S. PATENT DOCUMENTS 3,591,942 7/1971 Swearingen ..... 40/135
4,091,441 5/1978 Ott ..... 315/360
4,641,227 2/1987 Kusuhara ..... 362/1

*Primary Examiner*—Don Wong
*Assistant Examiner*—Wilson Lee
*Attorney, Agent, or Firm*—Nikaido, Marmelstein, Murray & Oram LLP

[57] ABSTRACT

An illumination apparatus for illuminating paintings at least a part of which is painted by a particular paint that emits or reflects light upon reception of ultraviolet ray, has a first illumination lamp constituted of an ultraviolet lamp and a second illumination lamp constituted of incandescent lamps. The ultraviolet lamp and incandescent lamps are controlled by a control circuit to be repetitively turned on and off as time elapses in accordance with a control sequence selected by an observer. While the incandescent lamps are turned on, the ultraviolet lamp is turned off to make the painting viewed as, e.g., a daytime landscape without showing, e.g., a nighttime landscape, and while the incandescent lamps are turned on, the ultraviolet lamp is turned on to make the same painting viewed as the nighttime landscape.

5 Claims, 8 Drawing Sheets

ILLUMINATION APPARATUS AND FRAME TO WHICH THE ILLUMINATION APPARATUS IS ATTACHED

BACKGROUND OF THE INVENTION

This invention relates to an apparatus for illuminating paintings, posters, and those duplications (hereinafter collectively referred to as "paintings") and a frame to which such an illumination apparatus is attached.

A particular paint that emits or reflects certain light upon reception of ultraviolet radiation from an ultraviolet lamp (so called "black light") has been devised and used for production of paintings. The paintings are produced in a fashion that such a particular paint is placed in some part of the painting area, e.g., in a crescent portion over a circle area that is painted by a regular paint as the sun. When one of such paintings is observed under a sufficiently bright incandescent lamp, the sun portion is literally perceived as the sun while remaining portions depicting a landscape are seen brightly. That is, in this situation, this painting is observed as a daytime landscape. To the contrary, when the incandescent lamp is dimmed and the painting is observed with an ultraviolet light radiated from an ultraviolet lamp (black light), the sun portion is perceived as a dark portion, and only the crescent portion emits light. That is, in this situation, this painting is observed as a nighttime landscape.

We have developed some illumination apparatus in which the ultraviolet lamp is normally turned on and the incandescent lamp can be turned on and off by a switch control, to illuminate paintings using those paints. With such an illumination apparatus, the incandescent lamp is turned on and off upon control of the switch, thereby arbitrarily changing, between the daytime landscape and the nighttime landscape, the appearance of the paintings using the particular paint.

Switching control of the incandescent lamp, which is performed each time, however, creates inconvenience and abrupt changes from daytime to nighttime and thus makes such changes unnatural. To eliminate such inconvenience and to make changes between the daytime and nighttime landscapes closely natural as much as possible, we have devised an illumination apparatus that automatically repeats by a control circuit a sequence that the incandescent lamp is turned on when a previously set time elapses, gradually increases the lamp brightness, maintains the brightness for a prescribed period, is gradually dimmed, and then is turned off. In this illumination apparatus, it is to be noted that the ultraviolet lamp is normally turned on. According to the illumination apparatus, no switching control of the incandescent performed each time is required, and furthermore, the painting is perceived, as a nighttime landscape due to the ultraviolet radiation from the ultraviolet lamp where the incandescent lamp is turned off, then gradually as a morning landscape as shifted from the nighttime landscape in accordance with increase of brightness upon turning on of the incandescent lamp, then as a daytime landscape where the incandescent lamp is brightest, then gradually as a sunset landscape as the incandescent lamp is more dimmed, and as the nighttime landscape again when the incandescent lamp is turned off.

However, because the illumination apparatus thus described has the ultraviolet lamp normally turned on even while the incandescent lamp is turned on, the particular paint may emit light upon the ultraviolet radiation from the ultraviolet lamp, thereby rendering the painted portions of the particular paint recognizable by observers of the paintings, in association with watching angles of the observers, brightness of the incandescent lamp at the peak, number of the incandescent lamps, and size of the paintings, even where the incandescent lamp is turned on and brightness of the lamp reaches the peak or maximum. This makes difficult to adequately express differences between the daytime landscape and nighttime landscape and negates unexpectedness at a time of changes from the daytime landscape to the nighttime landscape, thereby reducing the commercial value of the apparatus.

SUMMARY OF THE INVENTION

It is an object of the invention to provide an illumination apparatus for illuminating paintings which express, e.g., a daytime landscape and a nighttime landscape commonly in use of a particular paint that emits or reflects light upon ultraviolet light, capable of adequately expressing differences between the daytime landscape and the nighttime landscape, ensuring unexpectedness at a time when the appearance of the painting changes from the daytime landscape to the nighttime landscape, enabling observers to watch the landscapes corresponding to gradual natural changes, and creating realistic feeling in observers' mind.

In one form of the invention, an illumination apparatus includes a first illumination lamp made of an ultraviolet lamp, a second illumination lamp made of an incandescent lamp, and control means for controlling turning on and off of the first and second illumination lamps and controlling brightness of the second illumination lamp. The control means controls the second illumination lamp to operate in a repetitive sequence in which the second illumination lamp is made gradually brighter from a turned-off situation of the second illumination lamp for a first preset period, keeps the maximum brightness for a second preset period, is gradually dimmed for a third preset period subsequent to the second preset period, and keeps turned off of the lamp for a fourth preset period subsequent to the third preset period. The control means also controls the first illumination lamp to operate in a repetitive sequence in which the first illumination lamp is turned off for a fifth preset period while the second illumination lamp is turned on and the first illumination lamp is turned on for a sixth preset period including a period while the second illumination lamp is turned off.

According to a preferred embodiment of the invention, the control means includes a memory storing multiple control programs, selects one control program among the control programs stored in the memory, and executes operations according to the selected control program. The illumination apparatus may further include a transmitting apparatus for transmitting a manipulation signal, and a receiving apparatus for receiving the manipulation signal sent from the transmitting apparatus, and the control means may select the control program in accordance with the manipulation signal. An indication lamp emitting multiple color lights can be used for emitting such color lights corresponding to the selected control program.

In another form of the invention, a frame for paintings to which an illumination apparatus having a structure described above is used.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
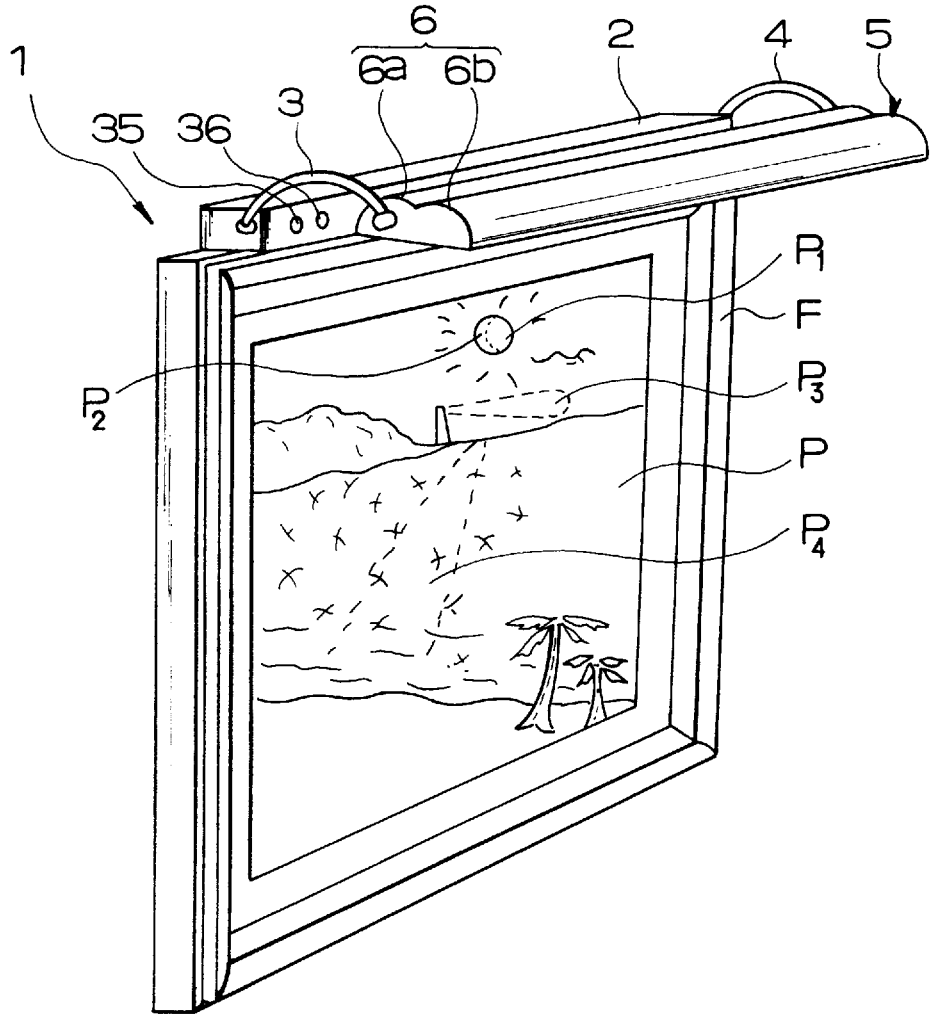
FIG. 1 is a perspective view showing an illumination apparatus, attached to a frame, according to a preferred embodiment of the invention and showing a painting at a situation that an incandescent lamp of the apparatus is brightest.
Figure 2:
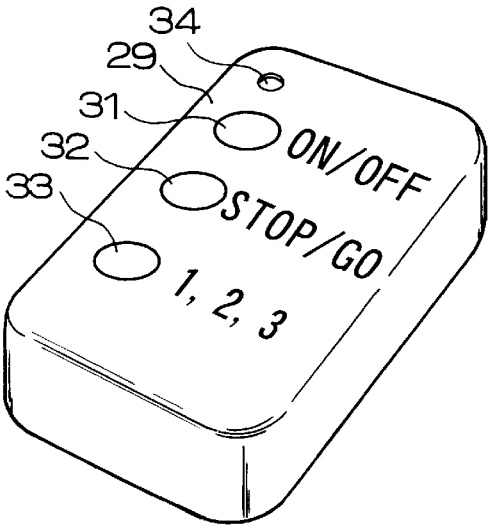
FIG. 2 is a perspective view showing a remote controller used for the illumination apparatus shown in FIG. 1.
Figure 3:
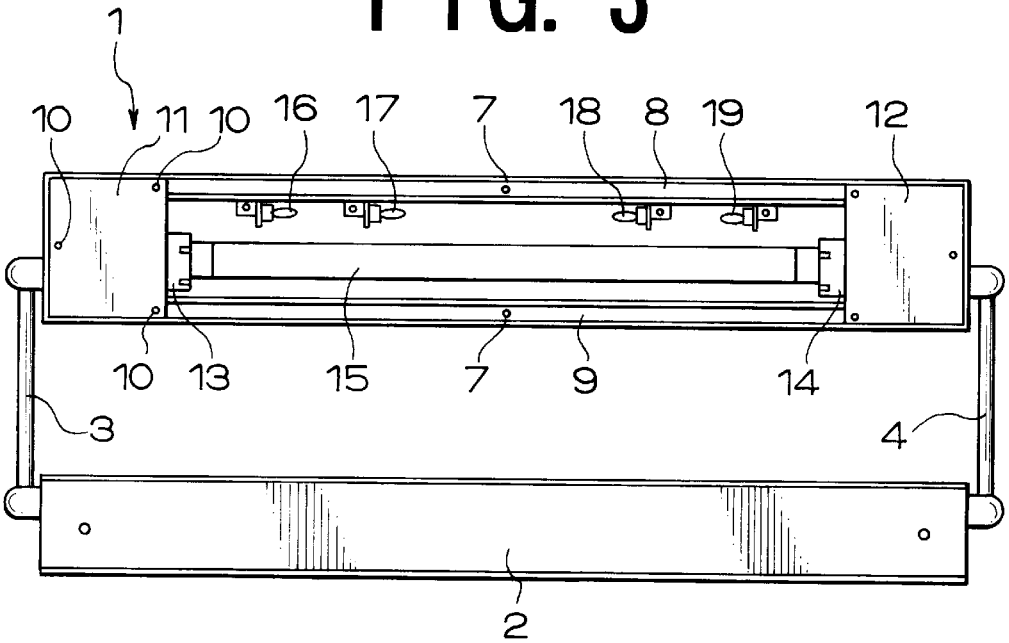
FIG. 3 is a bottom view showing the illumination apparatus shown in FIG. 1.

Referring to FIGS. 1 to 4, an illumination apparatus, designated by reference number 1, according to an embodiment of the invention is shown. As shown in FIG. 2, the illumination apparatus 1 is used by being attached to a frame F that holds a painting P produced in use of a particular paint that emits or reflects light upon reception of ultraviolet ray. The shown painting P depicts a seashore landscape, or a seascape, in which the sun, mountains, sea, palm trees, etc. are depicted with regular paints that are ordinarily used, and in which a crescent shape P2 using the particular paint is drawn in a shape P1 showing the sun. In the painting P, a shape P3 illustrating light from a lighthouse and shapes P4 illustrating reflections on the sea level of moon light coming from the crescent, are illustrated in use of the particular paint. In FIG. 1, broken lines show the shapes P2 to P4 drawn with the particular paint.

The illumination apparatus 1 has an apparatus body 2 fixedly mounted on a top of the frame F, a first arm 3 whose proximal end is secured to a right side of the apparatus body 2, a second arm 4 whose proximal end is secured to a left side of the apparatus body 2, and an illumination section 5 pivotably supported to the distal ends of the first and second arms 3, 4.

The apparatus body 2 incorporates a control circuit serving as a control means for turning on and off first and second illumination lamps as described above. The first and second arms 3, 4 are formed in an arch shape, respectively, and the inside of each arm has a hollow, through which lead lines, not shown, are placed to provide electricity for lamps. That is, the lead lines provide electrical connections between the control circuit and both of the ultraviolet lamp (black lights) serving as the first illumination lamp and the first to fourth incandescent lamps 16 to 19 serving as the second illumination lamps.

The illumination section 5 attached to the distal ends of the first and second arms 3, 4 is made unitedly of metal or synthetic resin and has a lampshade 6 formed with a pair of arched lamp houses 6*a*, 6*b*. The lampshade 6 incorporates a strip front attachment 8 that secured to a front side face of the lampshade 6 by screws 7 and a strip rear attachment 9 secured in parallel with the front attachment 8 to a rear side face of the lampshade 6 by screws 7. Left and right side lids 11, 12 are secured to left and right sides of the front and rear attachments 8, 9 by screws 10. A pair of connectors 13, 14 having connection terminals is mounted on back sides of the side lids 1 1, 12, respectively. The ultraviolet lamp 15 serving as the first illumination lamp of this invention is detachably attached to those connectors 13, 14, while the incandescent lamps 16 to 19 are attached in line on a rear side face of the front attachment 8.

Figure 4:
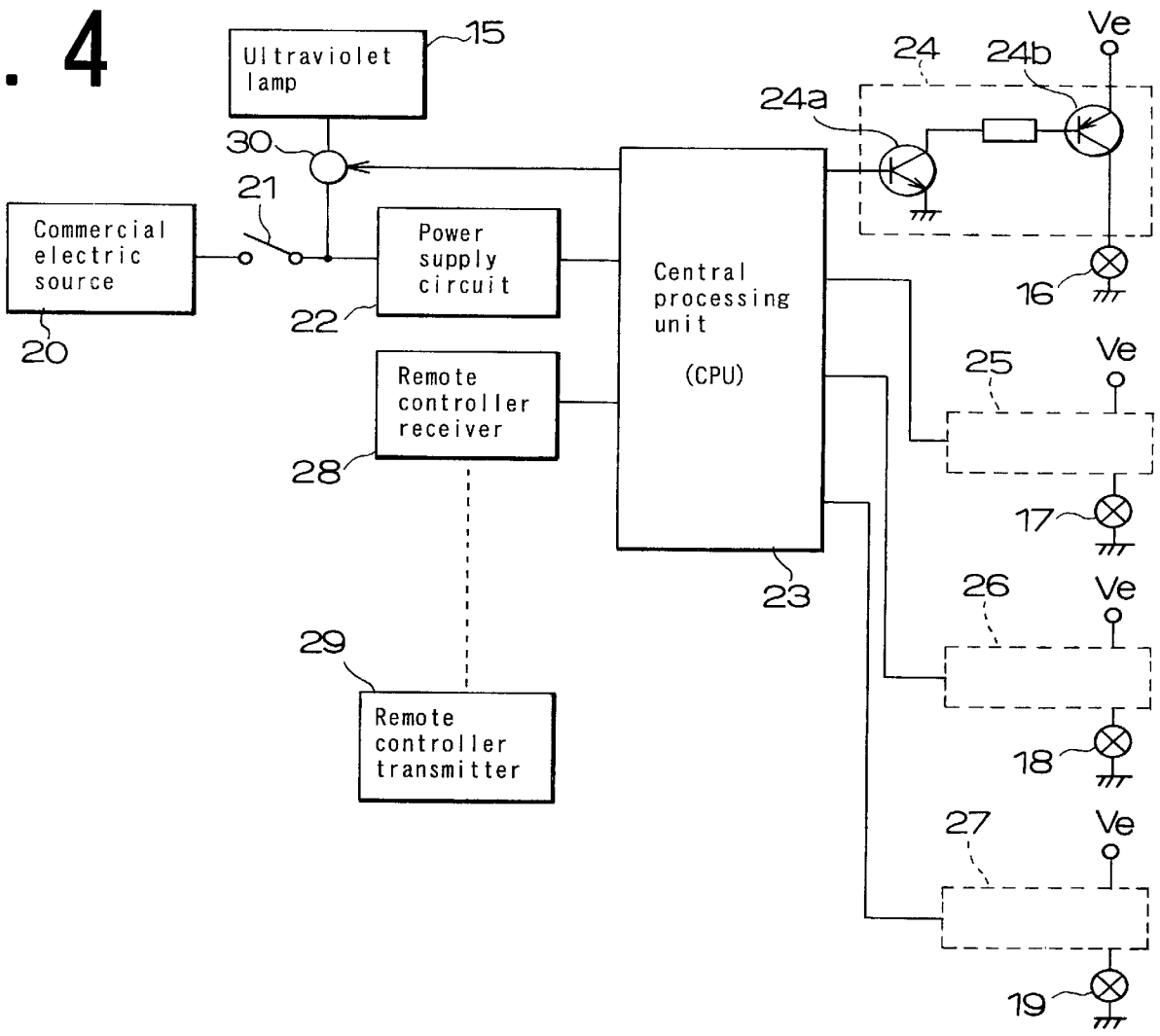
FIG. 4 is a block diagram showing a control circuit in the illumination apparatus.

In this illumination apparatus 1, the control circuit built in the apparatus body 2 controls the ultraviolet lamp 15 and the incandescent lamps 16 to 19. The control circuit, as shown in FIG. 4, includes a CPU (central processing unit) 23. A power supply circuit 22 to which power is given from a power source 20 or an electric outlet through a main switch 21 feeds power to the CPU 23. The CPU 23 also includes a memory serving as a program storage as described below and is connected to the incandescent lamps 16 to 19 through drivers 24 to 27, respectively. The ultraviolet lamp 15 is connected to the power source 20 through the main switch 21 and a switching element 30, which is controlled by the CPU 23.

A remote controller receiver 28 serving as a receiver is connected to the CPU 23. This remote controller receiver 28 receives a manipulation signal transmitted from a remote controller transmitter 29 serving as a transmitter and transfers the signal to the CPU 23. The CPU 23 executes various operations according to the manipulation signal.

The first to fourth incandescent lamps 16 to 19 are controlled repetitively to be turned on and off by the CPU 23 and the drivers 24 to 27 as shown in FIGS. 5 to 8. Each driver 24 to 27 includes an npn type control transistor 24*a* whose base terminal is coupled to the CPU 23, and a pnp type drive transistor 24*b* whose base terminal is coupled to the collector terminal of the control transistor 24*a*. The emitter terminal of the control transistor 24*a* is grounded, and the emitter terminal of the drive transistor 24*b* is supplied with power supply voltage Ve. One end of the incandescent lamps 16 to 19 is connected to the collector terminal of the drive transistor 24*b*, and the other end of the incandescent lamps 16 to 19 is grounded.

The CPU 23 includes a memory 37 serving as a program storage. The memory 37 stores brightness values of the ultraviolet lamp 15 and the incandescent lamps 16 to 19 corresponding to lapsed time, i.e., control sequences as first to third control sequences. First to third switches 31 to 33 are formed on the remote controller transmitter 29 as shown in FIG. 2. The first switch 31 is provided to transmit the manipulation signal for start and stop of the CPU operation. The second switch 32 is provided to transmit the manipulation signal to stop gradual brightness changes, dimmed or becoming brighter, of the incandescent lamps 16 to 19 and turning on or off of the ultraviolet lamp 15 as to maintain each brightness at that time as well as to resume such changes. The third switch 33 is provided to transmit the manipulation signal for selecting one control sequence among multiple control sequences stored in the memory regarding turning on and off of the incandescent lamps 16 to 19 and the ultraviolet lamp 15. An error lamp 34 is built on the remote controller transmitter 29 to indicate malfunctions due to e.g., short-circuit in the illumination apparatus 1.

With this illumination apparatus 1, a first lamp 35 is built to indicate, by turning on and off of the lamp, operating status of the CPU 23 and whether the incandescent lamps 16 to 19 and the ultraviolet lamp 15 maintain their brightness (see FIG. 1). That is, the first lamp 35, by manipulation of the second switch 32 built on the remote controller transmitter 29, is turned on when the incandescent lamps 16 to 19 and the ultraviolet lamp 15 maintain their brightness at that time (halt status) and turned off when the halt status is released. A second lamp 36 is also built as shown in FIG. 1 in juxtaposed to the first lamp 35 in the illumination apparatus 1. This second lamp 36 shows, by the emitted light color of the lamp, which control sequence is currently selected by the third switch 33 built on the remote controller transmitter 29, and constitutes an indication light of this invention. The second lamp 36 emits red light when the first control sequence is selected, green light when the second control sequence is selected, and orange light when the third control sequence is selected. The first and second lamps 35, 36 thus built can be formed at an outer edge of the frame F.

Figure 5:
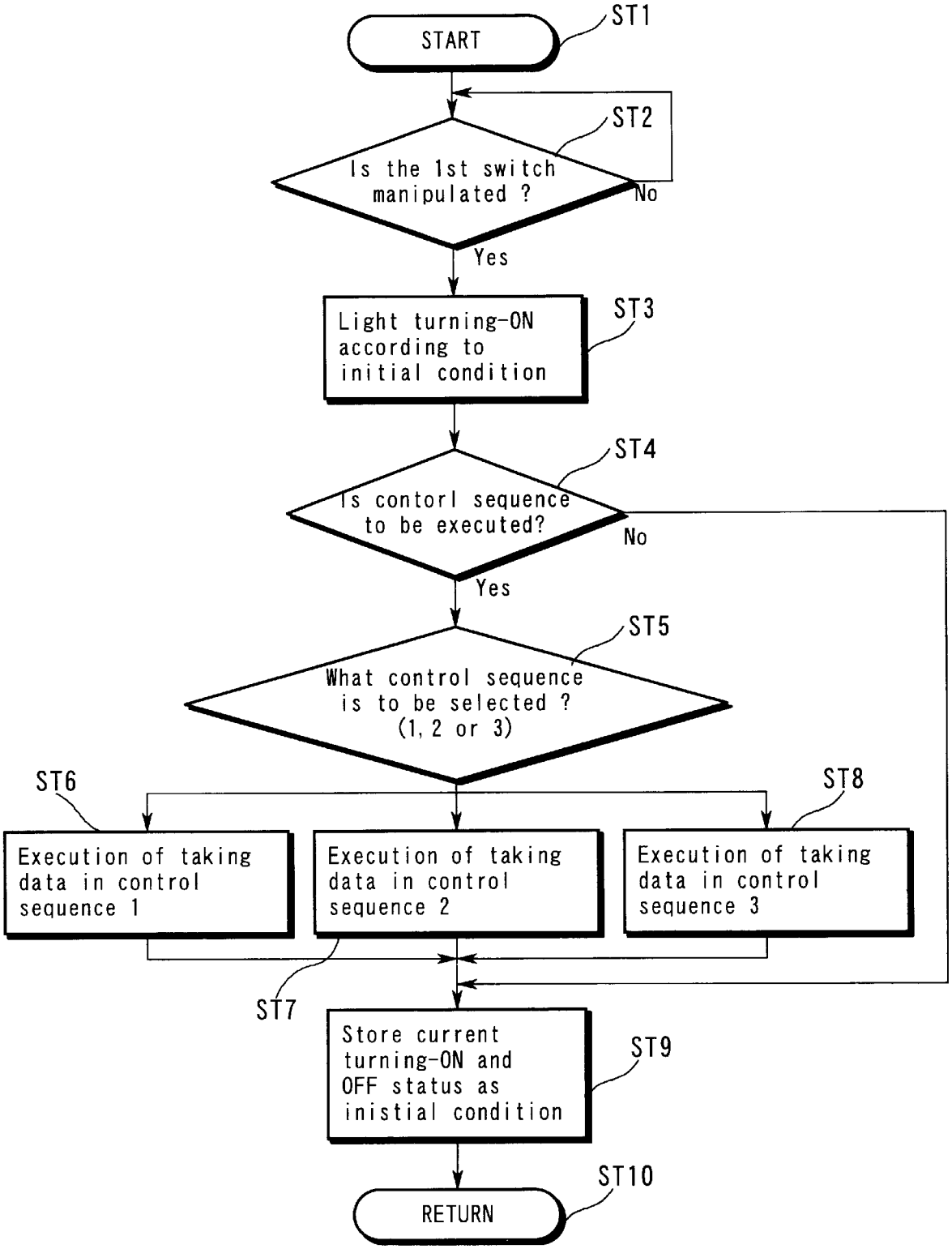
FIG. 5 is a flowchart showing operation of the control circuit in FIG. 4.

In operation of the illumination apparatus 1, when the main switch 21 is turned on, the CPU 23 starts its operation at step st1 as shown in the flowchart as FIG. 5, and at step st2 the CPU 23 judges whether the first switch 31 is manipulated. If the first switch 31 is not manipulated, the program stops at step st2. If the first switch 31 is manipulated, the execution of the CPU 23 goes to step st3. At step st3, the CPU 23 executes light turning-on operation according to an initial condition stored in the memory 37. The CPU 23 then judges at step st4 whether an execution of a control sequence is selected by the second switch 32. If no execution of a control sequence is selected, the program proceeds to step st9, and if an execution of a control sequence is selected, the program proceeds to step st5. At step st5, the CPU 23 judges which control sequence is selected; if the first control sequence is selected, the program goes to step st6; if the second control sequence is selected, it goes to step st7; and if the third control sequence is selected, it goes to step st8. At step st6, the CPU 23 retrieves the first control sequence data from the memory 37 and executes the first control sequence, and then the program proceeds to step st9. At step st7, the CPU 23 retrieves the second control sequence data from the memory 37 and executes the second control sequence, and then the program proceeds to step st9. At step st8, the CPU 23 retrieves the third control sequence data from the memory 37 and executes the third control sequence, and then the program proceeds to step st9. At step st9, the memory 37 stores the current turning on and off status as the initial condition, and then the program proceeds to step st10 to return to the start.

Figure 6:
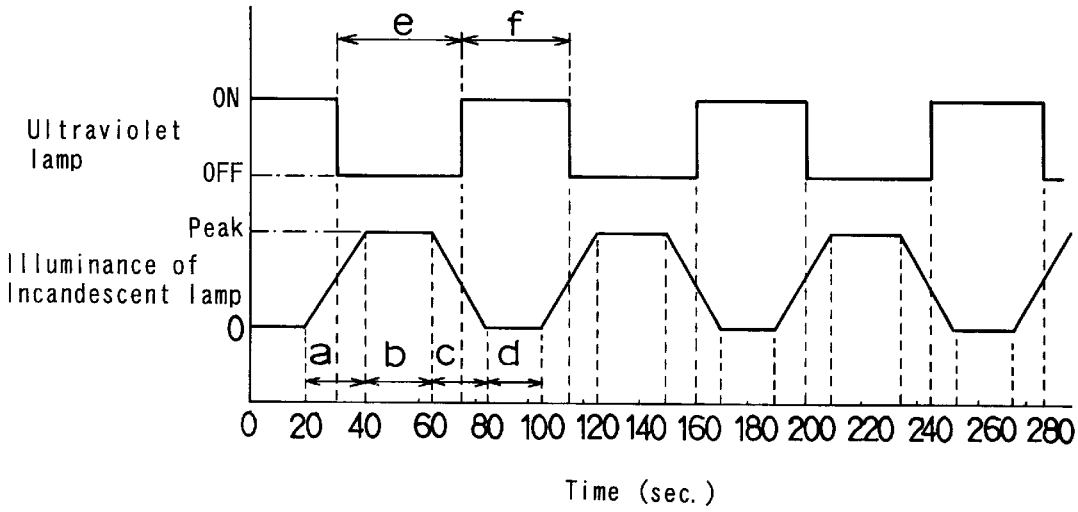
FIGS. 6 to 8 are graphs each showing a different control sequence of an ultraviolet lamp and an incandescent lamp of the illumination apparatus.

More specifically, to operate this illumination apparatus 1, the main switch 21 is turned on to operate the power supply circuit 22, and the first switch 31 of the remote controller transmitter 29 is manipulated. In the case when the first control sequence is executed, as shown in FIG. 6, the incandescent lamps 16 to 19 are turned on after a predetermined period (20 seconds) elapses, and the brightness of the lamps gradually increases within a first preset period a (20 seconds) and reaches the maximum brightness. When a second preset period b (25 seconds) elapses after the brightness reaches the maximum brightness, the incandescent lamps 16 to 19 are dimmed within a third preset period c (20 seconds) and become turned off. Then, the lamps are turned on after a fourth preset period d (20 seconds). The illumination apparatus 1 is controlled to repeat this sequence.

During this first control sequence, as shown in FIG. 6, the ultraviolet lamp 15 is controlled to be repeatedly turned on and off. The ultraviolet lamp 15 is turned off for a fifth preset period e (45 seconds, a period from when a half of the period a elapses to when a half of the period c elapses) while the incandescent lamps 16 to 19 are turned. The ultraviolet lamp 15 is then turned on for a sixth preset period f (40 seconds, a period from when a half of the period c elapses to when a half of the subsequent period a elapses) including a period where the incandescent lamps 16 to 19 are turned off.

Figure 7:
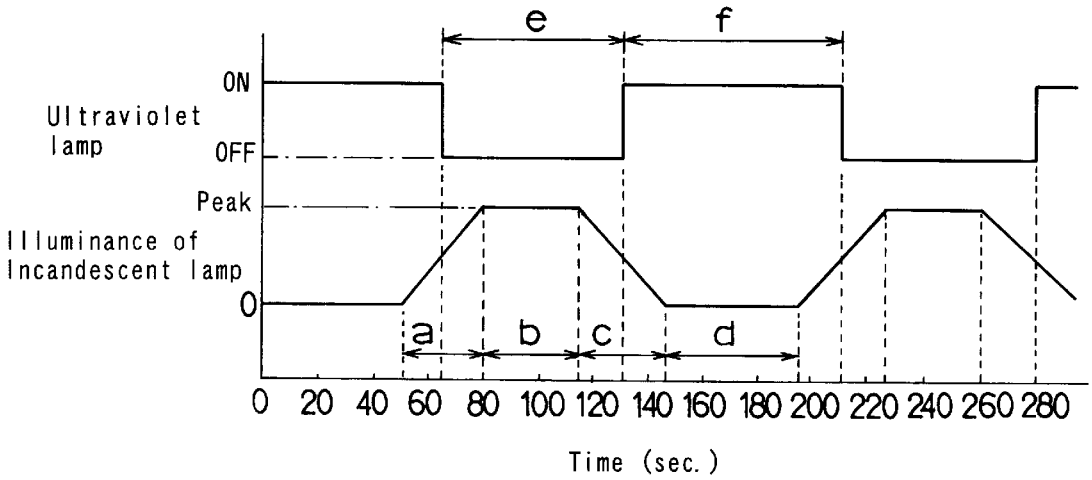

In the case when the second control sequence is executed, as shown in FIG. 7, after a predetermined period (50 second), the incandescent lamps 16 to 19 are turned on, and the brightness of the lamps gradually increases within a first preset period a (30 second) and reaches the maximum brightness. When a second preset period b (35 seconds) elapses after the brightness reaches the maximum brightness, the incandescent lamps 16 to 19 are dimmed within a third preset period c (30 seconds) and become turned off Then, the lamps are turned on after a fourth preset period d (50 seconds). The illumination apparatus 1 is controlled to repeat this second control sequence.

During this second control sequence, as shown in FIG. 7, the ultraviolet lamp 15 is controlled to be repeatedly turned on and off. The ultraviolet lamp 15 is turned off for a fifth preset period e (65 seconds, a period from when a half of the period a elapses to when a half of the period c elapses) while the incandescent lamps 16 to 19 are turned. The ultraviolet lamp 15 is then turned on for a sixth preset period f (80 seconds, a period from when a half of the period c elapses to when a half of the subsequent period a elapses) including a period where the incandescent lamps 16 to 19 are turned off.

Figure 8:
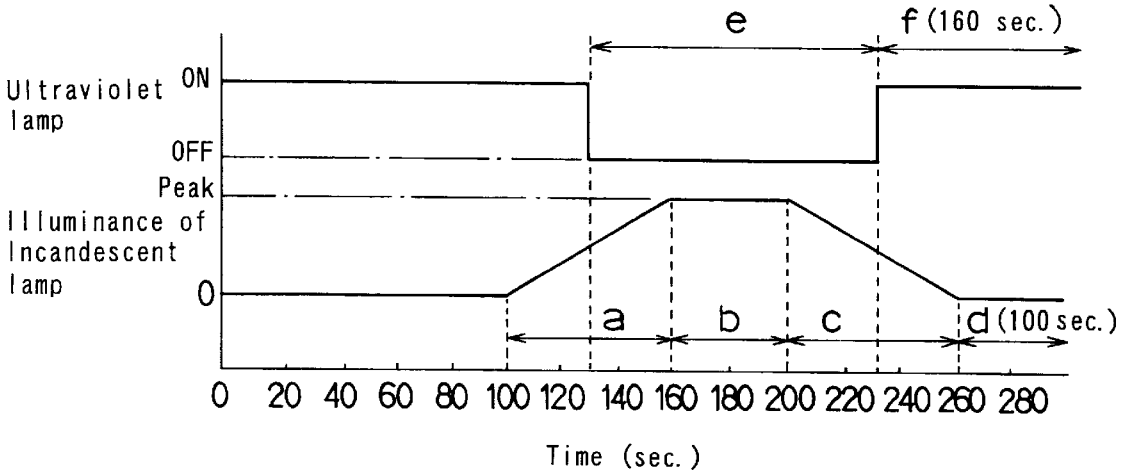

In the case when the third control sequence is executed, as shown in FIG. 8, after a predetermined period (100 second), the incandescent lamps 16 to 19 are turned on, and the brightness of the lamps gradually increases within a first preset period a (60 second) and reaches the maximum brightness. When a second preset period b (40 seconds) elapses after the brightness of the lamps reaches the maximum value, the incandescent lamps 16 to 19 are dimmed within a third preset period c (60 seconds) and become turned off. Then, the lamps are turned on after a fourth preset period d (100 seconds). The illumination apparatus 1 is controlled to repeat this second control sequence.

During this third control sequence, as shown in FIG. 8, the ultraviolet lamp 15 is controlled to be repeatedly turned on and off. The ultraviolet lamp 15 is turned off for a fifth preset period e (100 seconds, a period from when a half of the period a elapses to when a half of the period c elapses) while the incandescent lamps 16 to 19 are turned. The ultraviolet lamp 15 is then turned on for a sixth preset period f (160 seconds, a period from when a half of the period c elapses to when a half of the subsequent period a elapses) including a period where the incandescent lamps 16 to 19 are turned off.

Figure 9:
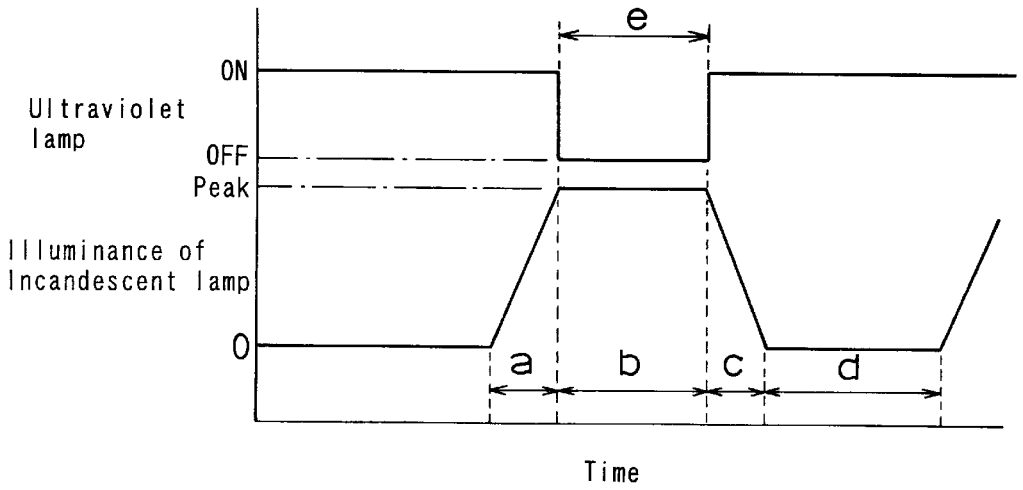
FIGS. 9, 10 are graphs showing modified control sequences, respectively, different from the control sequences in FIGS. 6 to 8.
Figure 10:
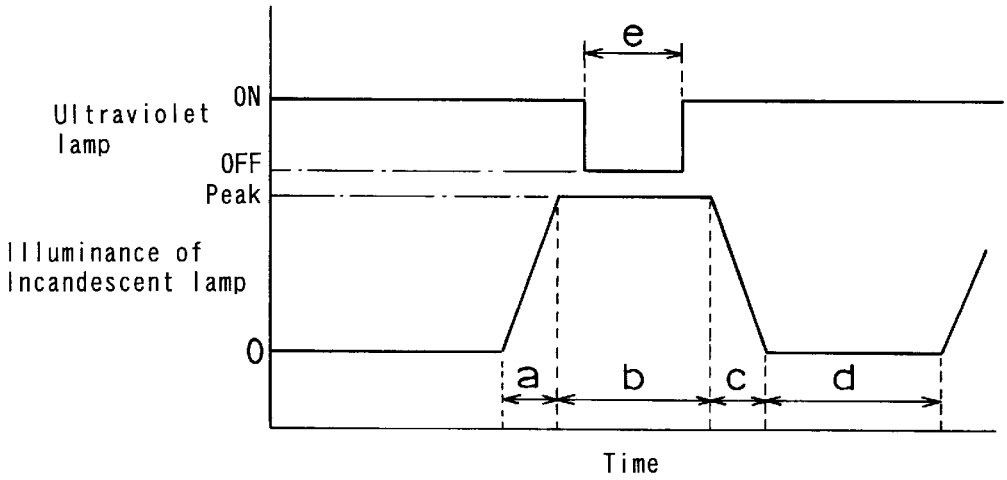

It is to be noted that the period (the fifth period e) in which the ultraviolet lamp 15 is turned off can be longer than the period where the lamps 16 to 19 maintain their maximum brightness, or the second preset period b, but can be equal to the second preset period b as shown in FIG. 9 or can be shorter than the second preset period as shown in FIG. 10. The brightness of the ultraviolet lamp 15 can be controlled to be higher than, equal to, or lower than the maximum brightness of the incandescent lamps 16 to 19.

The illumination apparatus 1 makes the ultraviolet lamp 15 turned on when the main switch 21 is turned on and the first switch 31 of the remote controller transmitter 29 is manipulated, and makes the CPU 23 operate, through the power supply circuit 22, to repeat turning on and off of the incandescent lamps 16 to 19 and the ultraviolet lamp 15 according to the selected control sequence as shown in FIGS. 6 to 8 stored in the memory 37 of the CPU 23. While each control sequence is executed, the CPU 23 reads in brightness value data from the memory 37 corresponding to the lapsed time and controls the base current of the drive transistor 24*a* by means of a D/A converter, not shown, formed at the CPU 23. The drive transistor 24*b* changes the current flowing from the emitter to the collector, thereby controlling the current value (brightness) flowing through the incandescent lamps 16 to 19.

When wanting to stop brightness changes of the incandescent lamps 16 to 19 and the ultraviolet lamp 15 and to maintain the brightness at that time, an operator manipulates the second switch 32 built on the remote controller transmitter 29. To change the control sequences or to select one of the control sequences of the incandescent lamps 16 to 19 and the ultraviolet lamp 15, the operator manipulates the third switch 33.

Figure 11:
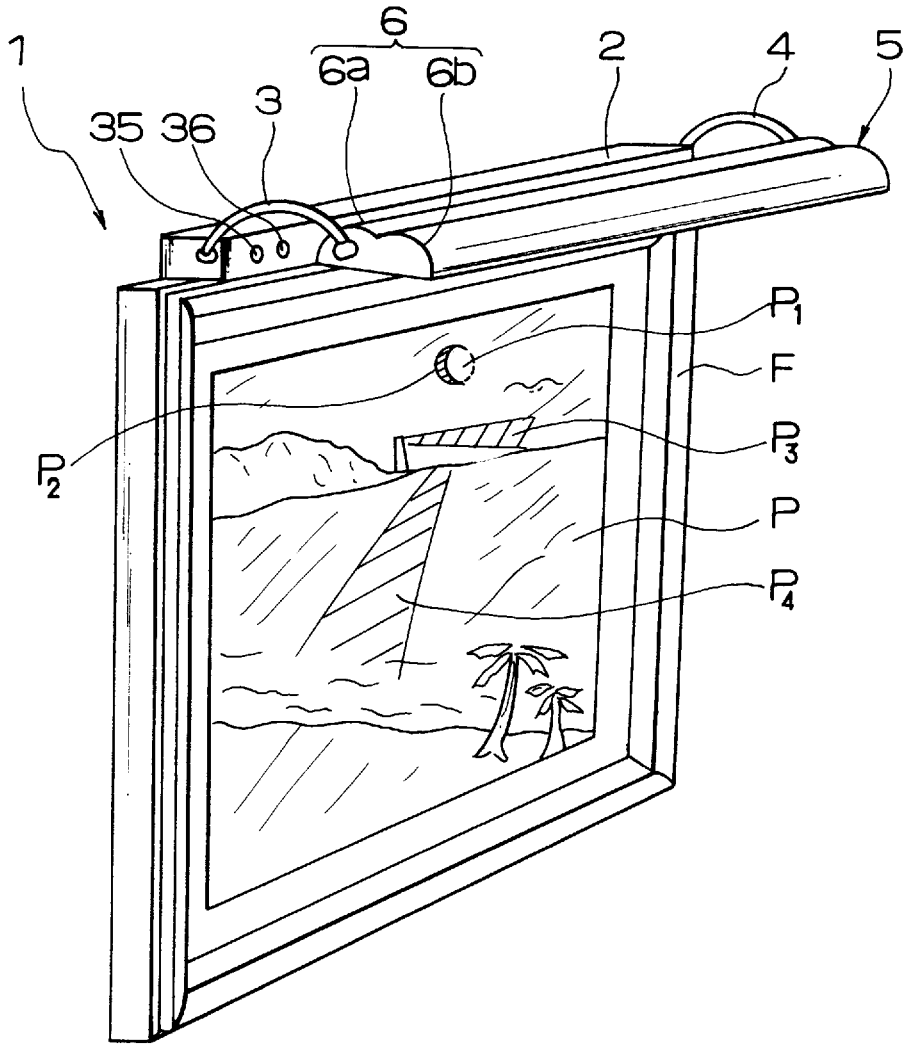
FIG. 11 is a perspective view showing an illumination apparatus, attached to a frame, according to a preferred embodiment of the invention and showing a painting at a situation that an incandescent lamp of the apparatus is turned off.

According to the illumination apparatus 1 thus having the incandescent lamps 16 to 19 that change their brightness according to the control sequence and the ultraviolet lamp 15 that is controlled to be turned on and off in accordance with the brightness changes of the incandescent lamps 16 to 19, the entire painting P can be recognized as very dark as shown in FIG. 11, when the ultraviolet lamp 15 only is turned on and the incandescent lamps 16 to 19 are turned off. At that time, only the crescent shape P2, the shape P3 showing light from the lighthouse, and shapes P4 of the moon light being reflected on the sea level, on which the particular paint that emits or reflects light upon reception of ultraviolet ray from the ultraviolet lamp 15 is painted, are recognized as brighter than other areas on which other paints are painted. Accordingly, this painting P is recognized as a nighttime landscape.

After a certain time elapses from the situation above, as shown in FIGS. 6 to 8, the incandescent lamps 16 to 19 are made turned on and increase their brightness. As the brightness of the incandescent lamps 16 to 19 increases, the brightness of the entire painting P increases gradually. The shapes P2 to P4 on which the particular paint is painted, are getting hard to be recognized gradually, and then, when the ultraviolet lamp 15 is turned off and the incandescent lamps 16 to 19 brighten most, the shapes P2 to P4 fall totally to be indistinguishable. Thus, the entire painting P is recognized as a daytime landscape.

As described above, the illumination apparatus 1 can gradually change the landscape shown by the painting P into a nighttime landscape, a morning landscape, a daytime landscape, an evening landscape, and the nighttime landscape corresponding to a natural change as time lapses, where the apparatus 1 is used for the painting P at least a part of which is painted by the particular paint that emits or reflects light upon reception of ultraviolet ray. Therefore, the illumination apparatus 1 and the frame to which the illumination apparatus 1 is attached allow observers to obtain realistic feeling and unexpectedness of changes, thereby giving great relaxation to the observers. Moreover, the observers can obtain further relaxation by listening to music in use of headphones or the like, while watching the painting P using this illumination apparatus 1.

In the embodiment above, the first illumination lamp constituted of the ultraviolet lamp and the second illumination lamp constituted of the incandescent lamps for forming the illumination apparatus according to the invention, are formed at the illumination section 5 pivotably supported to the distal ends of the arms 3, 4. However, the first and second illumination lamps are not required to be formed at the illumination section 5, and for example, ultraviolet lamps serving as the first illumination lamp can be attached to left and right ends of a frame, not shown, to which the painting is attached, and incandescent lamps serving as the second illumination lamp can be attached to upper and lower portions of the frame. Although in the embodiment above, the second illumination lamp is described as the four incandescent lamps 16 to 19, the number of the incandescent lamps is not limited to four, and can be a single or plural.

As apparent from the description of the embodiment above, according to the illumination apparatus of the invention and the frame to which the illumination apparatus is attached, the incandescent lamps serving as the second illumination lamp repeats prescribed control sequences in which the lamps is brightened and dimmed as time elapses, and the first illumination lamp constituted of the ultraviolet lamp is turned off while the second illumination lamp is turned on. Where this illumination apparatus is used for paintings at a part of which a particular paint that emits or reflects light upon reception of ultraviolet light is painted, the illumination apparatus allows observers to recognize changes in expression of the paintings with highly realistic feeling and great unexpectedness and thereby to obtain great relaxation.

Where the illumination apparatus has the memory storing multiple control sequence data, since one sequence is selected from the multiple control sequences to execute the operation complying with the selected control sequence, one painting brings various changes as time elapses. Where the remote controller transmits the manipulation signal to select one of the control sequences, the observer can control very conveniently the apparatus from a remote place, e.g., a couch or sofa in a living room, to select one control sequence. The observer can also see which control sequence is selected by indication of the indication lamp or lamps that emits multicolor lights corresponding to the selected control sequence.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but the be defined claims set forth below.

What is claimed is:

1. An illumination apparatus adapted for illuminating paintings having an area painted in use of a particular paint that emits or reflects light upon reception of ultraviolet light, comprising:

a first illumination lamp made of an ultraviolet lamp;

a second illumination lamp made of an incandescent lamp; and control means for controlling turning on and off of the first and second illumination lamps and controlling brightness of the second illumination lamp, wherein the control means controls the second illumination lamp to operate in a repetitive sequence in which the second illumination lamp is made gradually brighter from a turned-off situation of the second illumination lamp for a first preset period, keeps the maximum brightness for a second preset period, is gradually dimmed for a third preset period subsequent to the second preset period, and keeps turned off of the lamp for a fourth preset period subsequent to the third preset period, and wherein the control means controls the first illumination lamp to operate in a repetitive sequence in which the first illumination lamp is turned off for a fifth preset period while the second illumination lamp is turned on and the first illumination lamp is turned on for a sixth preset period including a period while the second illumination lamp is turned off.

2. The illumination apparatus according to claim 1, wherein the control means includes a memory storing multiple control programs, selects one control program among the control programs stored in the memory, and executes operations according to the selected control program.

3. The illumination apparatus according to claim 2, further comprising a transmitting apparatus for transmitting a manipulation signal, and a receiving apparatus for receiving the manipulation signal from the transmitting apparatus, wherein the control means selects the control program in accordance with the manipulation signal.

4. The illumination apparatus according to claim 2, further comprising an indication lamp emitting multiple color lights, wherein the indication lamp emits the lights corresponding to the selected control program.

5. A frame on which an illumination apparatus adapted for illuminating paintings having an area painted in use of a particular paint that emits or reflects light upon reception of ultraviolet light, is attached, the illumination apparatus comprising:

a first illumination lamp made of an ultraviolet lamp;

a second illumination lamp made of an incandescent lamp; and control means for controlling turning on and off of the first and second illumination lamps and controlling brightness of the second illumination lamp, wherein the control means controls the second illumination lamp to operate in a repetitive sequence in which the second illumination lamp is made gradually brighter from a turned-off situation of the second illumination lamp for a first preset period, keeps the maximum brightness for a second preset period, is gradually dimmed for a third preset period subsequent to the second preset period, and keeps turned off of the lamp for a fourth preset period subsequent to the third preset period, and wherein the control means controls the first illumination lamp to operate in a repetitive sequence in which the first illumination lamp is turned off for a fifth preset period while the second illumination lamp is turned on and the first illumination lamp is turned on for a sixth preset period including a period while the second illumination lamp is turned off.

* * * * *